US005544979A

United States Patent [19]

White

[11] Patent Number: 5,544,979

[45] Date of Patent: Aug. 13, 1996

[54] CLAMP ASSEMBLIES FOR DRIVING CAISSONS INTO THE EARTH

[75] Inventor: John L. White, Kent, Wash.

[73] Assignee: American Piledriving Equipment, Inc., Kent, Wash.

[21] Appl. No.: 408,023

[22] Filed: Mar. 21, 1995

[51] Int. Cl.[6] ..... E21B 7/24; E02D 7/18

[52] U.S. Cl. ..... 405/232; 405/231; 405/249; 173/162.1

[58] Field of Search ..... 405/232, 228, 405/231, 249; 173/162.1, 49, 164

[56] References Cited

U.S. PATENT DOCUMENTS

| | | | |
|---|---|---|---|
| 2,126,933 | 8/1938 | Stone et al. | 166/77.4 |
| 3,096,075 | 7/1963 | Brown | 254/29 R |
| 3,797,570 | 3/1974 | Leutwyler | 166/77.4 |
| 3,828,864 | 8/1974 | Haverkamp et al. | 173/49 |
| 4,567,952 | 2/1986 | Lemaire et al. | 173/164 |
| 5,092,399 | 3/1992 | Lang | 166/77.53 |
| 5,117,925 | 6/1992 | White | 173/162.1 |
| 5,263,544 | 11/1993 | White | 173/162.1 |
| 5,388,652 | 2/1995 | Smith | 175/85 |

FOREIGN PATENT DOCUMENTS

| | | |
|---|---|---|
| 0362158 | 4/1990 | European Pat. Off. . |
| 4010357A1 | 10/1990 | Germany . |

*Primary Examiner*—Stephen J. Novosad

*Attorney, Agent, or Firm*—Hughes, Multer & Schacht, P.S.

[57] ABSTRACT

A clamp assembly for attaching a pile to a device for inserting and/or extracting the pile. The clamp assembly has a fixed gripping assembly and a movable gripping assembly. The fixed gripping assembly is rigidly attached to a housing. The movable gripping assembly is rotatably attached to a pivot arm that is pivotably attached to the housing. The pile is placed between the gripping assemblies and a piston causes the pivot arm to rotate such that the pile is gripped between the gripping assemblies. The movable gripping assembly rotates relative to the pivot arm into a desirable position relative to the pile as it engages the pile to increase the ability of the clamp assembly to grip the pile. An anvil formed on the top of the clamp assembly facilitates attachment of the clamp assembly to the pile driving and/or extracting device and alleviates damage to the bolts used to attach the clamp assembly to the pile driving and/or extracting device.

19 Claims, 6 Drawing Sheets

CLAMP ASSEMBLIES FOR DRIVING CAISSONS INTO THE EARTH

TECHNICAL FIELD

The present invention relates to clamps that allow vibratory devices to be attached to elongate members and, more particularly, such clamps that are adapted to grip caissons that are being inserted under overhanging structures such as bridges.

BACKGROUND OF THE INVENTION

In the construction industry, it is often necessary to insert caissons into the earth. As examples, caissons are inserted into the earth during new construction as part of a foundation for a structure; caissons are also commonly driven under a bridge or the like when providing additional structural resistance to earthquake damage.

To insert a caisson into the earth, a large driving force must be applied thereto. Often, vibratory devices are employed to introduce a vibratory force along the axis of the caisson during the driving process. The combination of a static driving force with a dynamic vibratory force is usually sufficient to overcome the earth's resistance and allow the caisson to be inserted therein.

A clamping assembly must be provided to allow vibratory forces to be effectively transmitted to the caisson. Such clamping assemblies have heretofore normally been adapted to engage the upper end of the caisson. In this case, sufficient clearance must be present above the upper end of the caisson to accommodate the clamping assembly and vibratory device.

The Applicant is also aware of at least one instance where a hole was formed in a plate and vibratory devices mounted on the plate. The caisson was passed through the hole in the plate and hydraulic clamps attached to the plate engage the side walls of the caisson to fix it relative to the plate. While the clamp assembly engages the side walls and not the top end of the caisson, the clamp assembly and vibratory devices must be raised above the upper end of the caisson to pass the caisson through the hole in the plate. Accordingly, this arrangement still requires clearance above the caisson upper end to accommodate the clamping assembly and vibratory device.

In new construction, the construction process may be scheduled to ensure that adequate clearance is present above the caisson to allow the clamping assembly and vibratory device to be raised over the upper end thereof.

In other situations, such as when caissons are being inserted under a bridge or other previously erected structure, the available clearance may be limited. In such cases, the caisson must be shortened such that the total length of the caisson, clamping assembly, and vibratory device fits within the available clearance. Using a shorter caisson means that caisson sections must be welded together such that the entire caisson extends into the earth to the required depth. Welding caisson sections together is a time and labor intensive process that drives up the cost of inserting caissons into the earth.

Accordingly, the need exists for methods and apparatus for attaching a vibratory device to a caisson that can be used effectively in spaces with restrictive headroom.

From the following discussion, it will be apparent that this and other problems with prior art caisson clamping assemblies are solved by the present invention.

OBJECTS OF THE INVENTION

From the foregoing, it should be clear that one primary object of the present invention is to provide an improved clamp assembly for securely attaching a caisson to a vibratory device or the like.

A further object of the invention is to provide a caisson clamp assembly having a favorable combination of the following characteristics:

(a) reduction in the clearance required to drive a caisson;

(b) minimizes the number of welds required to drive a caisson to a desired depth; and (c) allows quick and easy change from one caisson to the next.

As will become clear from the following detailed discussion, these and other objects are achieved by the caisson clamping assembly of the present invention.

SUMMARY OF THE INVENTION

In it most basic form, the present invention is a clamping device for connecting a vibratory device to a caisson to be driven into the earth using vibratory forces. The clamping device comprises a base plate having a generally u-shaped slot formed therein. Mounted on the base plate near a closed end of this slot is a clamping jaw. A gate jaw is removably mounted onto the base plate near an open end of the slot. The caisson enters the slot when the gate jaw is removed or in an open position. The gate jaw is then locked in a closed position to close off the open end of the slot. The clamping jaw is hydraulically forced against the caisson to grip the caisson against the gate jaw.

This configuration allows the vibratory device and any ancillary equipment such as a suppressor to be attached to the caisson from the side, requiring little or no clearance between the caisson and an overhanging structure such as a bridge or the like.

The clamping assembly describe above is preferably used in the context of a driving system further comprising a lead, a sled movable up and down the lead, a crane or the like for supporting the lead, and a pair of vibro/suppressor units.

In this case, the vibro/suppressor units are symmetrically mounted on the base plate on either side of the slot formed therein. The sled is rigidly attached to each of the suppressors. The gate jaw may be opened or removed to expose the slot, at which point the crane is used to displace the base plate towards caisson until the caisson enters the slot. The gate jaw is then locked into the closed position and the gripping jaw forced against the caisson.

DETAILED DESCRIPTION

Figure 1:
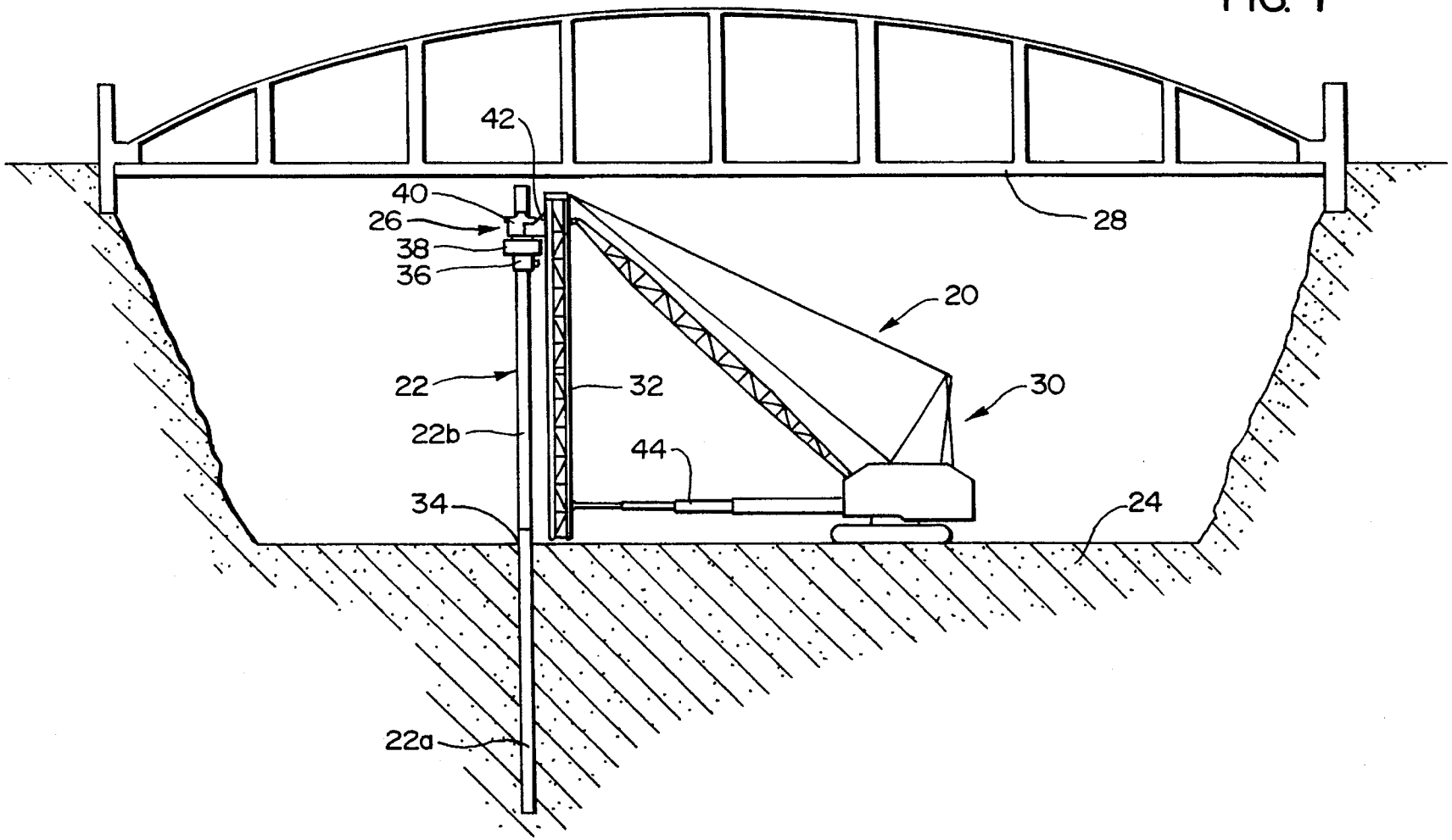
FIG. 1 is a side view depicting a system for driving caissons incorporating a clamping assembly constructed in accordance with, and embodying, the principles of the present invention.

Referring now to the drawing, depicted at 20 therein is a system for driving a caisson 22 into the earth 24. This system 20 employs a drive assembly 26 constructed in accordance with, and embodying, principles of the present invention. The caisson driving system 20 is shown driving caisson 22 underneath a bridge 28, although the system 20 may be used in environments other than that depicted in FIG. 1.

The caisson driving system 20 further comprises a crane 30 and a lead 32. The lead 32 is supported by the crane 30, while the driving assembly 26 is mounted on the lead 32 above a location 34 in the ground 24 where the caisson 22 is to be inserted. As discussed above, this location 34 is underneath the bridge 28.

The caisson 22 is used as part of a system for reinforcing the bridge 28 to resist earthquake-induced damage. The design and placement of such caissons is well known in the art and will not be discussed herein. The following discussion will relate primarily to the caisson driving system 20 and the methods implemented by this system 20 to drive the caisson 22 into the earth 24 at a location and to a depth prescribed by the bridge or other structure 28 being supported.

The driving assembly 26 basically comprises a vibratory portion 36, a clamping portion 38, and a suppressor portion 40 and is mounted on a sled 42. The sled 42 is mounted to move up and down along the lead 32. A brace 44 is connected between the crane 30 and lead 32 to facilitate positioning of the lead 32. The clamping portion 36 is mounted on the vibratory assembly 38 and engages the caisson 22 to prevent relative movement between the vibratory assembly 38 and caisson 22.

Figure 2:
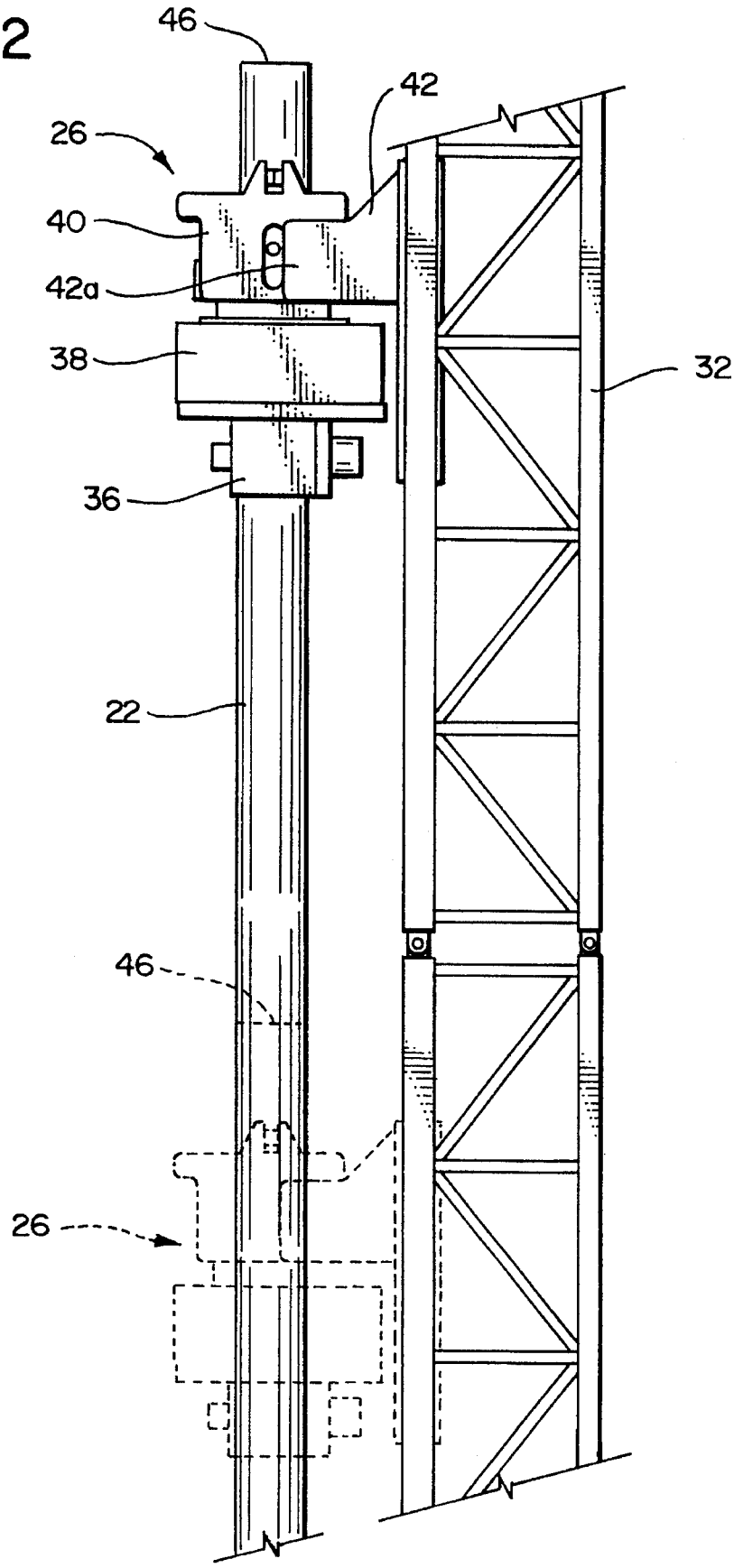
FIG. 2 is a side view depicting details of a driving device employed by the system shown in FIG. 1.

The vibratory assembly 38 is mounted to the sled 42 by the suppressor assembly 40. In particular, the sled 42 comprises two sled projections, only one of which, identified by reference character 42*a*, is shown in FIG. 2. As will be discussed further below, the suppressor assembly 40 comprises two portions. Each of the two projections from the sled 42 are rigidly attached to one of the portions of the suppressor assembly 40.

The driving assembly 26 is attached to the caisson 22 and operated to drive the caisson 22 into the earth 24. The clamping portion 38 of the present invention allows the driving assembly 26 to be attached to and removed from the caisson 22 from the side; the driving assembly 26 thus need not be lifted over the top of the caisson 22 as did prior art driving assemblies discussed above.

The ability to clamp the caisson from the side is important because, in many situations, the desired depth to which the caisson 22 is to be driven is farther than the clearance between the ground 24 and the overhanging structure such as the bridge 28. In such situations, the caisson 22 is formed in sections such as those identified by 22*a* and 22*b* in FIG. 1. When the caisson 22 comprises such sections, the first section 22*a* is initially driven into the ground 24. The second section 22*b* is then welded to the first section 22*a*. The first and second sections are then driven into the ground until the entire caisson 22 reaches the desired depth.

The basic process of driving the caisson sections 22*a* and 22*b* is shown in more detail in FIG. 2. FIG. 2 illustrates that the sled 42 is movable between an uppermost position as shown by solid lines and a lower position as shown by broken lines. While it is possible to positively drive the sled 42 between these positions using a cable, chain, or other drive means, more commonly the driving force is generated simply by the weight of the driving assembly 26 and the caisson 22 in conjunction with the vibratory forces generated by the vibratory assembly 38.

Figure 3:
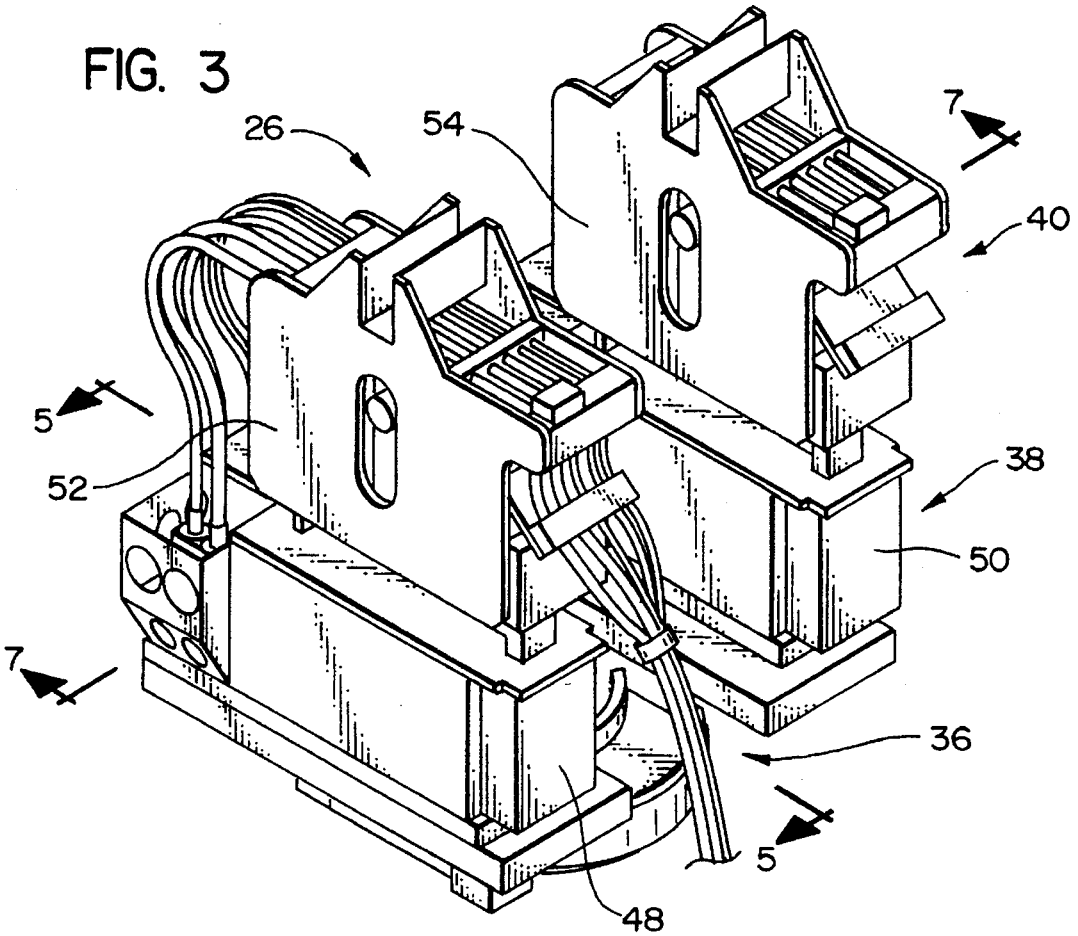
FIG. 3 is a perspective view of the driving device shown in FIGS. 1 and 2.
Figure 4:
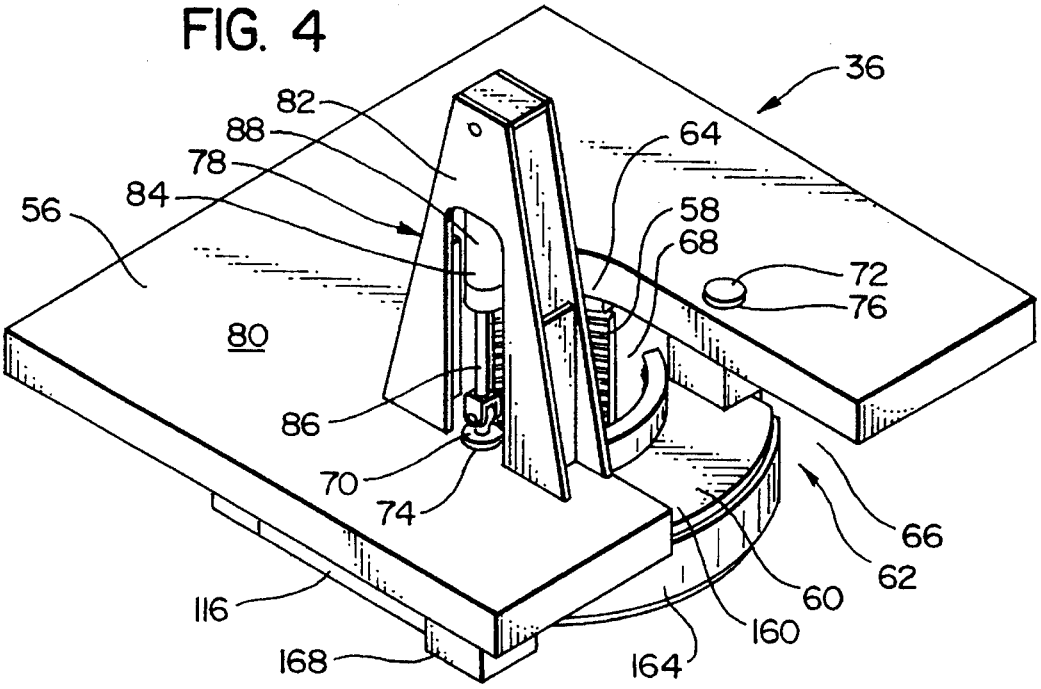
FIG. 4 is a perspective view of the clamping assembly forming a part of the driving device shown in FIG. 3.

Referring now to FIGS. 3 and 4, these Figures show the drive assembly 26 in further detail. In particular, FIG. 3 shows the clamp assembly 36, vibratory assembly 38, and clamp assembly 40, while FIG. 4 shows only the clamp assembly 36 from the same perspective.

FIG. 3 shows that the vibratory assembly 38 comprises two separate vibratory devices (vibros) 48 and 50. Similarly, the suppressor assembly comprises two separate suppressors 52 and 54 mounted on these vibros 48 and 50, respectively. The vibros 48 and 50 and suppressors 52 and 54 are well known in the art. Ordinarily, a vibratory device such as the devices 48 and 50 are sold with a suppressor such as the suppressors 52 and 54 as a complete unit for driving piles and the like. Such vibratory devices and suppressors are sold in various sizes depending on the type of load being driven.

As shown in FIG. 3, two of these vibratory device/suppressor units are used as part of the present invention. The construction and operation of these combined units is generally well known and will not be described herein in detail. The present invention does solve certain problems associated with the use of two such combined units simultaneously, and the operation of these units will be described below to the extent necessary to describe how these problems are overcome.

Referring now to FIG. 4, depicted therein is the clamp assembly 36 generally described above. This assembly 36 basically comprises a mounting plate 56, a clamping jaw 58, and a gate jaw 60. A slot 62 is formed in the mounting plate 56 such that a closed end 64 thereof is located substantially in the center of the plate 56. Importantly, the gate jaw 60 can swing open or be entirely removed to allow a caisson to be arranged within the slot 62 from the side. The gate jaw 60 is then swung open or closed to allow the caisson to be clamped between the jaws 58 and 60.

More particularly, in FIGS. 3 and 4, the clamping jaw 58 is mounted adjacent to this closed end 64, while the gate jaw 60 is shown locked in a closed position relative to the base plate 56 adjacent to an open end 64 of the slot 62. With the gate jaw 60 arranged in its closed position as shown in FIG. 4, a generally cylindrical caisson-receiving cavity 66 is formed between the jaws 58 and 60 and extending through the closed end 64 of the slot 62.

The clamp assembly 36 operates basically as follows. When the gate jaw 60 is in the closed position as shown in FIG. 4, it presents a secure structural member against which a caisson may be clamped. The clamping jaw 58 is movable towards the gate jaw 60 to exert a clamping force on the caisson being clamped such that the caisson is gripped between the jaws 58 and 60. With the caisson so gripped, it is fixed relative to the base plate 56. As shown in FIG. 3, the vibratory devices 48 and 50 are securely mounted on the base plate 56. Therefore, with the caisson gripped between the jaws 58 and 60 as described above, the vibratory forces developed by the vibratory devices 48 and 50 are transmitted to the caisson through the base plate 56 and gripping members 58 and 60.

This clamping assembly allows the driving assembly 26 to be brought up to the caisson 22 from the side; there need not be clearance above the caisson being driven. Instead, the gate jaw 60 is displaced such that it does not impede passage of the caisson 22 through the slot 62. The driving assembly 26 is then displaced in a direction A (FIG. 6) extending substantially radially towards a lengthwise axis B of the caisson 22 such that the caisson 22 enters the slot 62 and is received in the closed end 64 thereof.

At this point, the gate jaw 60 is returned and locked into its closed position to prevent the removal of the caisson 22 from the slot 62 in a direction extending substantially radially away from the caisson axis B (opposite to the direction B) The clamping jaw 58 is then displaced until the caisson 22 is gripped as generally described above. The driving device 26 is similarly removed from the caisson 22 by again opening the gate jaw 60 and moving the driving assembly 26 away from the caisson 22 such that it exits the slot 62.

It should be noted that the vibro/suppressor units are symmetrically spaced on either side of the caisson-receiving cavity 68 to provide a balanced vibratory force to the caisson 22. In this regard, the vibro/suppressor units formed by the vibros 48 and 50 and suppressors 52 and 54 are thus located on either side of the slot 62.

Referring again to FIG. 4 and also to FIGS. 5 and 6, the construction and operation of the clamping assembly 36 will be described in further detail. Initially, FIG. 4 shows that first and second pins 70 and 72 extend through holes 74 and 76 in the base plate 56 on either side of the slot 62. With one of these pins 70 and 72 removed from its corresponding slot 74 and 76, the gate jaw 60 may be rotated about the remaining pin away from the closed position until it does not block entrance into or exit from the closed end 64 of the slot 62. The same result can be achieved by removing both of these pins 70 and 72 and completely removing the gate jaw 60 from the base plate 56.

The pins 70 and 72, holes 74 and 76 in the base plate, and corresponding holes in the gate jaw 60 (discussed below) form a locking means that allows the gate jaw 60 to be fixed in a closed position relative to the base plate or, when one of these pins is removed, rotated into an open position.

Referring again to FIG. 4, a pin retracting assembly 78 is mounted on an upper surface 80 of the base plate 56. This pin retracting assembly 78 comprises a support structure 82 and a piston assembly 84. The piston assembly 84 comprises a rod 86 and a cylinder 88. As is well known in the art, hydraulic fluid may be forced into the cylinder portion 88 to extend or retract the rod 86. The cylinder 88 is connected to the support structure 82, while the rod 86 is connected to the pin 70.

By operating the cylinder assembly 84 such that the shaft 86 is retracted into the cylinder 88, the pin 70 is removed from its hole in the gate jaw 60 to allow this jaw 60 to be rotated into its open position. On the other hand, when the jaw 60 is in its closed position, the piston assembly 84 may be operated to extend the shaft 86 to insert the pin 70 into the hole in the gate jaw 60, thereby locking the jaw 60 in its closed position.

Figure 5:
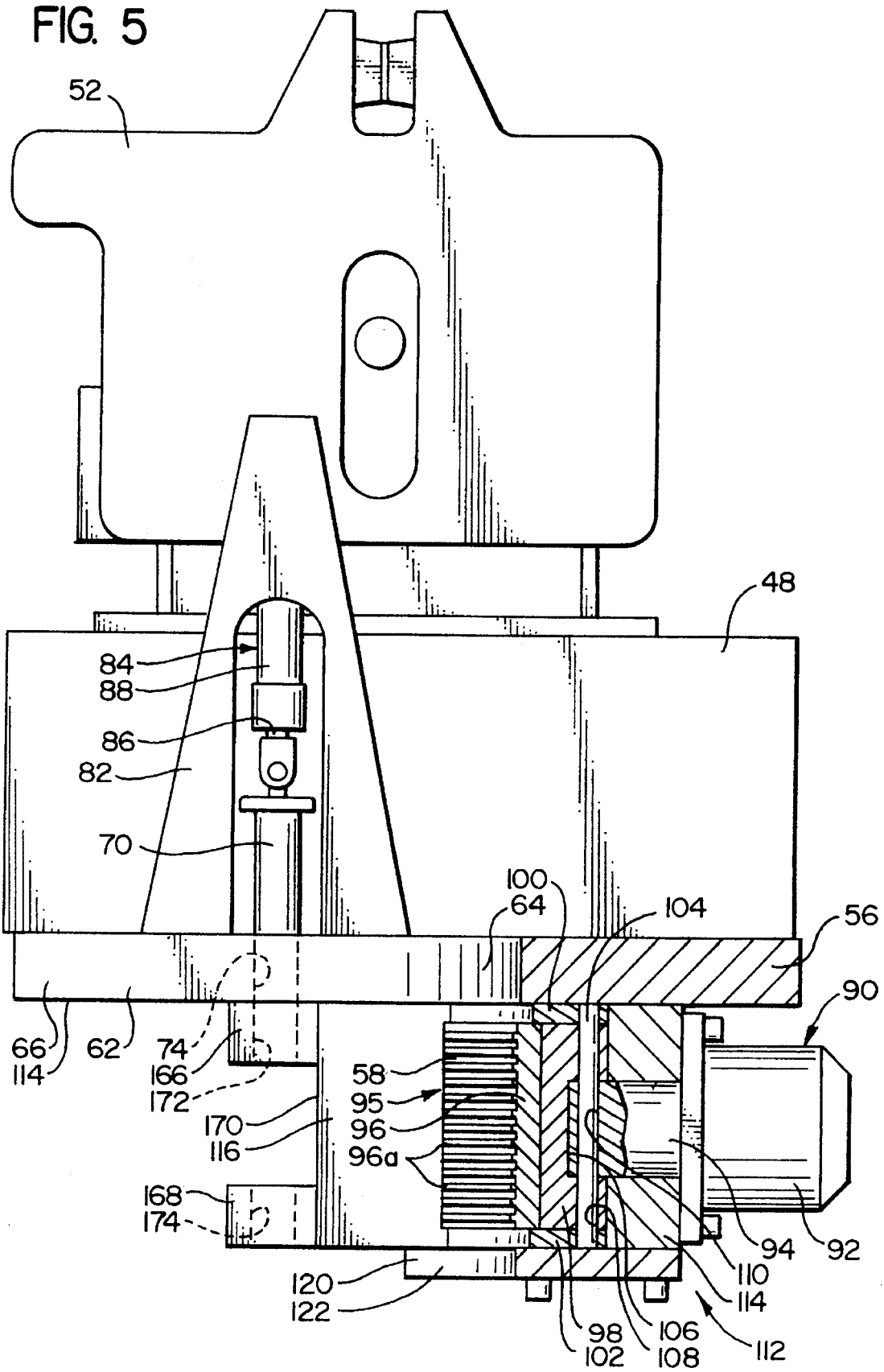
FIG. 5 is a partial cutaway view taken along lines 5—5 in FIG. 3.
Figure 6:
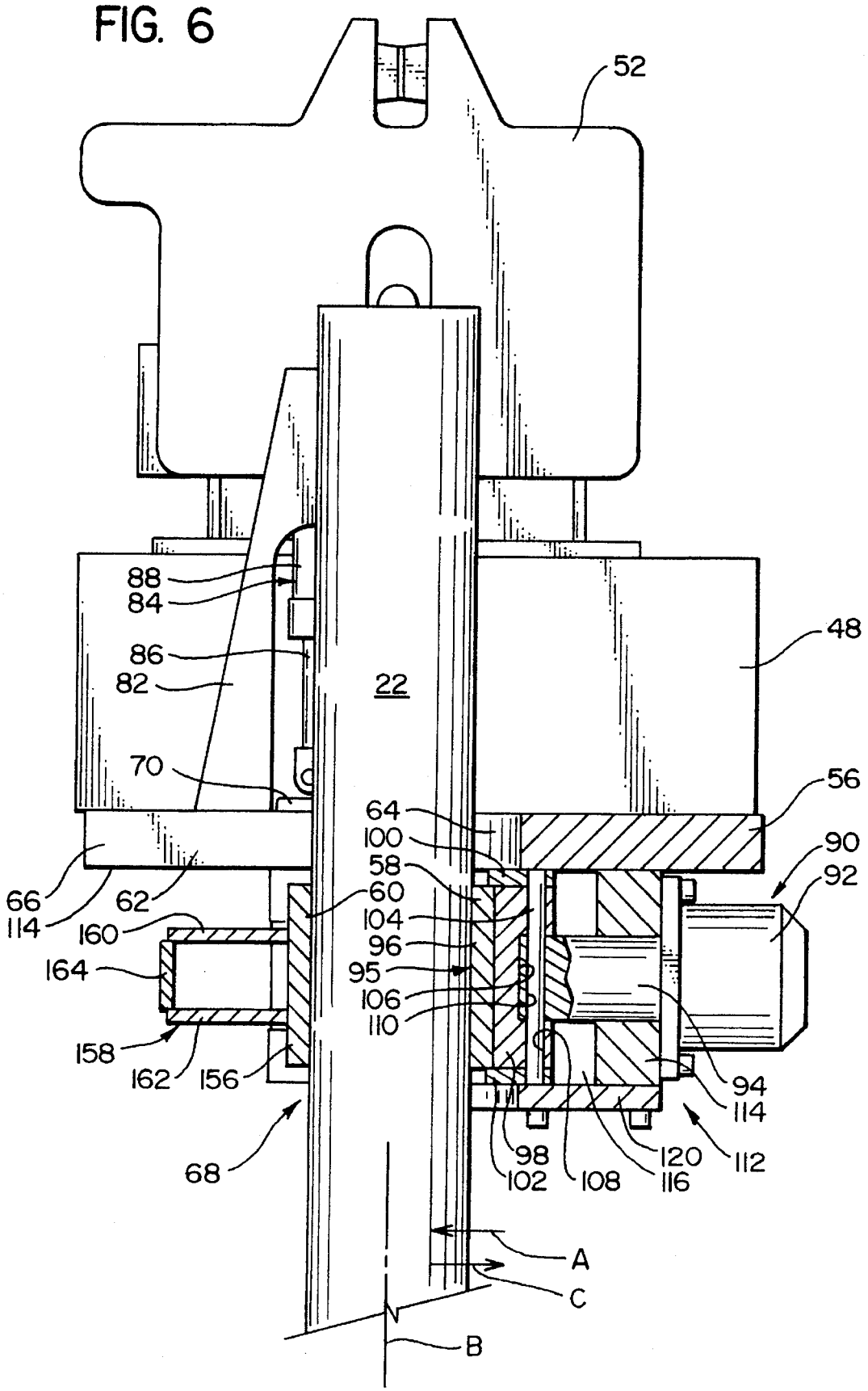
FIG. 6 is a partial cutaway view taken along lines 5—5 in FIG. 3, but showing the gate jaw removed or in its open position.

Referring now to FIGS. 5 and 6, the operation of the clamp assembly 36 will be described in further detail. In FIG. 5, the gate jaw 60 is in its open position and, given the location of the section view depicted in FIG. 5, is thus not visible. The piston assembly 84 is shown in FIG. 5 with the shaft 86 thereof fully retracted such that the pin 70 is withdrawn. Also, FIG. 5 shows the clamping jaw 58 in a relaxed position in which it is retracted away from the open end 66 of the slot 62.

In FIG. 6, the caisson 22 is shown in the caisson cavity 68 being gripped by the gripping and gate jaws 58 and 60. In this case, the gate jaw 60 is locked in its closed position by the pivot pin 70. The piston assembly 84 is thus operated such that its shaft 86 is extended to insert the pivot pin 70 into the hole in the gate jaw 60. At the same time, the clamping jaw 58 is extended into a gripping position in which it engages the caisson 22 and forces it against the gate jaw 60.

While the pivot pin 70 is hydraulically withdrawn, the jaw 60 is manually moved between its open and closed position. The clamping jaw 58 is-moved between its relaxed and gripping positions by a hydraulic assembly 90. This assembly 90 comprises a cylinder 92 and a rod 94. As is known in the art, introduction of hydraulic fluid into the cylinder 92 will extend or retract the rod 94. The rod 94 engages the clamping jaw 58 such that this jaw 58 moves back and forth with the extension and retraction of the shaft 94. The piston assembly 90 thus moves the jaw 58 between the relaxed position shown in FIG. 5 and the gripping position shown in FIG. 6.

The rear and gate jaws 58 and 60 will now be described in further detail with reference to FIGS. 4–6. Referring initially to FIG. 5, the clamping jaw 58 comprises: (a) a gripping weldment 95 comprising an engaging member 96, a backing member 98, an upper slide member 100, and a lower slide member 102; and (b) a pin member 104. The gripping member 96, the backing member 98, and the slide members 100 and 102 are welded to the backing member 98 to form the weldment 95.

Ridges **96*a* are formed on the gripping member 96. These ridges 96*a* form a textured surface that increases friction between the gripping member 96 and the caisson 22. The slide members 100 and 102 have smooth surfaces that allow the weldment 95** to slide relative to the structure within which it is mounted, as will be described in further detail below.

A cavity 106 is formed in the backing plate 98 to receive the rod 94. A bore hole 108 extends through the weldment 95 formed by the upper plate 100, backing plate 98, and bottom plate 102, passing through the cavity 106. A similar bore hole 110 passes through the rod 94. The pin member 104 extends through these bore holes 108 and 110 to fix the weldment 95 onto the rod 94 such that movement of the rod 94 is transferred to the engaging member 96.

Figure 7:
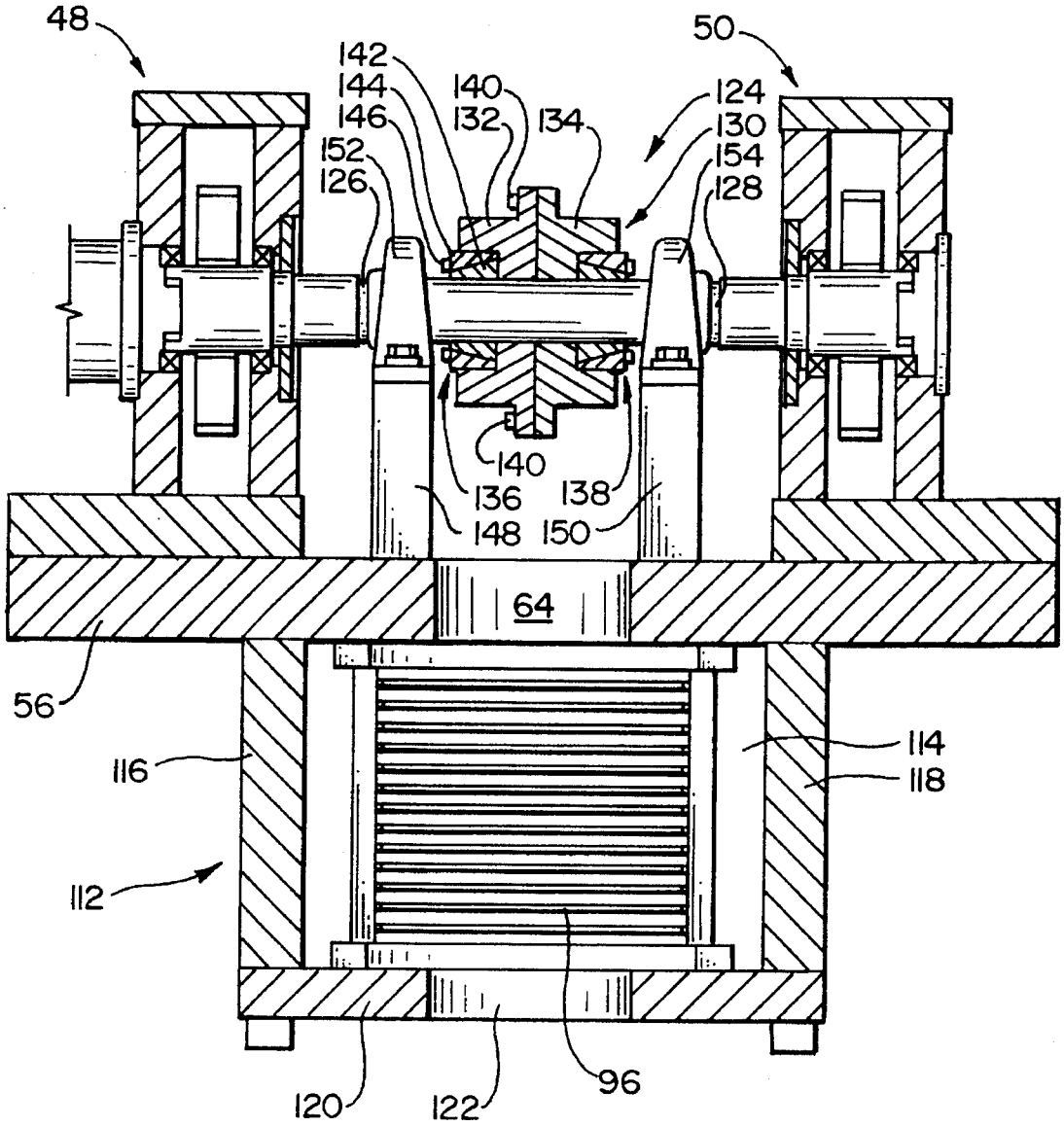
FIG. 7 is a partial cutaway view taken along lines 7—7 in FIG. 3.

FIGS. 5–7 further depict a clamp housing 112 welded to a bottom surface 114 of the base plate 56. One purpose of this housing 112 is to provide a stable structure that allows the clamping jaw 58, and the hydraulic assembly 90 attached thereto, to be mounted adjacent to the closed end 64 of the slot 62. Another important function of the housing 112 is to support the weldment 95 and thereby allow this weldment 95 to transfer vibratory forces to the caisson 22.

In particular, the housing 112 comprises a rear wall 114, a pair of side walls 116 and 118, and a bottom plate 120. The bottom plate 120 is bolted to the side walls 116 and 118 and may be removed to allow the weldment 95 to be repaired or replaced. A slot 122 is formed in the bottom plate 120 that is spaced below, and is coextensive with at least a portion of, the slot 62 in the base plate 56.

The slide members 100 and 102 engage the plates 56 and 120 to prevent relative up and down movement between the weldment 95 and the base plate 56. However, as discussed above, the housing 112 allows movement of the weldment 95 along a line radially extending from the center axis of the caisson 22. With the structure as just-described, when the vibratory assembly 38 is operating, the vibratory forces generated thereby are effectively transferred to the weldment 95. Without this housing 112, the weldment 95 would move up and down relative to the bottom plate 56, resulting in an inefficient transfer of vibratory forces to the caisson 22.

Referring now to FIG. 7, depicted at 124 therein is an alignment assembly for synchronizing the vibros 48 and 50. As mentioned, the vibros 48 and 50 are well-known and will not be discussed herein in detail. However, it should be noted that when two such vibros are used in tandem, they must be synchronized. The alignment assembly 124 accomplishes this as follows.

Cylindrical shafts 126 and 128 extend from the vibros 48 and 50. The center axes of these shafts 126 and 128 are aligned. By rotating these shafts 126 and 128, eccentrics (not shown) within the vibros 48 and 50 are rotated to create the vibratory forces described above. In the exemplary alignment assembly 124, the shaft 126 is directly turned by a hydraulic motor 128.

A coupling assembly 130 connects the shaft 128 to the shaft 126 such that rotation of the shaft 126 is transmitted to the shaft 128. This coupling assembly 130 comprises first and second collars 132 and 134 and first and second ring fetters 136 and 138. The collar 132 is placed over the end of the shaft 126 and the collar 134 is placed over the end of the shaft 128. These collars 132 and 134 are bolted together by bolts 140.

The ring fetters 136 and 138 fix the collars 132 and 134 to the shafts 126 and 128, respectively. The ring fetters 136 and 138 use friction to fix the collars to the shafts. These ring fetters 136 and 138 are the same, an only one of these will be described in further detail herein.

In particular, each of the ring fetters comprises at least one engaging member 142 having a curved surface and a slanted surface and at least one camming member 144 having a flat surface and a slanted surface. Axial rotation of a bolt 146 causes the camming member 144 to move towards the collar 132; movement of the camming member 144 forces the slanted surface thereon against the slanted surface on the engaging member 142, thereby forcing the curved surface thereon against the shaft 126.

The friction that develops between the curved surface on the engaging member 142 and the shaft 126 fixes the collar 132 relative to the shaft 126. The ring fetter 138 similarly fixes the collar 134 to the shaft 128. Since these collars 132 and 134 are bolted together by the bolts 140, axial rotation of the shaft 126 results in axial rotation of the shaft 128.

Because no teeth are used to transfer the rotation of one shaft to the other, the vibros 48 and 50 can be synchronized with a high degree of accuracy. This may most easily be accomplished by simply removing the bolts 140 and allowing the eccentrics within the vibros 48 and 50 to self-center at the bottom of their rotation by gravity. One of the ring fetters 136 and 138 is then loosened and one of the collars 132 and 134 rotated relative to its associated shaft until the bolt holes in these collars 132 and 134 are aligned. The bolts 140 are then inserted into these holes and tightened. The loosened ring fetter is next also tightened.

The coupling assembly 130 thus allows infinite adjustment between the two shafts 126 and 128 to ensure that the vibros are accurately synchronized.

It should also be noted that the exemplary alignment assembly 124 further comprises posts 148 and 150 that support bearings 152 and 154 for supporting the shafts 126 and 128 and coupling assembly 130 between the vibros 48 and 50.

Referring now to FIGS. 5 and 6, the gate jaw 60 will be described in further detail. This jaw 60 comprises an engaging member 156 similar to the engaging member 96 described above and a backing weldment 158 comprising top and bottom plates 160 and 162 and a curved front plate 164. The top plate 160 and front plate 164 are visible in FIG. 4. The weldment 158 braces the engaging member 156 to provide a stable fixed structure against which the caisson 22 may be forced by the clamping jaw 58.

FIG. 5 shows that two support blocks 166 and 168 are rigidly mounted to the front edge 170 of the side wall 116. A similar pair of support blocks is formed along a front edge of the side wall 118.

The blocks 166 and 168 have bore holes 172 and 174 formed therein for receiving the locking pin 70 described above. Similar bore holes (not shown) are formed in the top and bottom plates 160 and 162, and, as discussed above, the bore hole 74 is formed in the base plate 56. The pin 70 extends through these holes in the base plate 56, blocks 166 and 168, and plates 160 and 162 to lock the gate jaw 60 in place relative to the base plate 56.

The top and bottom plates 160 and 162 are snugly received between the blocks 166 and 168 to prevent relative movement between the weldment 158 and the base plate 56 under vibrational loads.

From the foregoing, it should be clear to one of ordinary skill in the art that the present invention may be embodied in forms other than those described above in detail. The above described embodiment is therefore to be considered in all respects illustrative and not restrictive, the scope of the invention being indicated by the appended claims rather than the foregoing description. All changes that come within the meaning and scope of the claims are intended to be embraced therein.

What is claimed is:

1. A clamp assembly for fixing a caisson to a driving apparatus for driving the caisson into the earth, the clamp assembly comprising:

a base plate connected to the driving apparatus, where a slot having an open end and a closed end is formed in the base plate;

a first gripping assembly slideably mounted on the base plate adjacent to the closed end of the slot;

a second gripping assembly;

locking means for fixing the second gripping assembly in a closed position relative to the base plate in which the second gripping assembly closes the open end of the slot; and locking means for fixing the second gripping assembly in a closed position relative to the base plate adjacent to the open end of the slot; and actuating means for displacing the first gripping assembly relative to the base plate between a relaxed position and a gripping position; wherein the caisson is arranged within and removed from the slot when the first gripping assembly is in the relaxed position and the second gripping assembly is not in the closed position; and the caisson is fixed to the attachment point when the first gripping assembly is in the gripping position and the second gripping assembly is in the closed position.

2. A clamp assembly as recited in claim 1, in which the locking means comprises first and second pivot pins that extend through the second gripping assembly and the base plate, where the first and second pivot pins are removable and, when one of the first and second pivot pins is removed, the second gripping assembly is pivotable about the other of the first and second pivot pins between an open position and the closed position.

3. A clamp assembly as recited in claim 2, further comprising actuator means for displacing the first pin between an inserted position and a withdrawn position, where the second gripping assembly can rotate into the open position when the first pin is in the withdrawn position and is locked into the closed position when the first pin is in the inserted position.

4. A clamp assembly as recited in claim 3, in which the actuator means comprises a piston assembly having one end attached to the base plate and a second end attached to the first pin, where extension and retraction of the piston assembly displaces the first pin along its axis between the inserted and withdrawn positions.

5. A clamp assembly as recited in claim 1, further comprising a support plate arranged parallel to the base plate, where the first gripping assembly is arranged between the base plate and the support plate to limit movement of the first gripping assembly in a direction parallel to a lengthwise axis of the caisson.

6. A clamp assembly as recited in claim 1, further comprising two pairs of support blocks rigidly fixed below the base plate, where the second gripping assembly is received between each pair of support blocks to limit movement of the second gripping assembly in a direction parallel to a lengthwise axis of the caisson.

7. A clamp assembly as recited in claim 6, in which the locking means comprises first and second pivot pins that extend through the second gripping assembly, the base plate, and at least one of the support blocks, where the first and second pivot pins are removable and, when one of the first and second pivot pins is removed, the second gripping assembly is pivotable about the other of the first and second pivot pins between an open position and the closed position.

8. A system for driving caissons into the earth, the system comprising:

means for supporting a lead structure above a desired location;

sled means movable along the lead structure, the sled means having first and second support projections extending therefrom;

a base plate, where a slot having an open end and a closed end is formed in the base plate;

first and second vibrating means for generating vibratory forces, the first and second vibrating means being rigidly mounted to the base plate on opposite sides of the slot;

first and second suppressing means connected between the first and second vibrating means and the first and second support projections, respectively, for inhibiting transmission of the vibratory forces generated by the first and second vibrating means to the first and second support projections;

a first gripping assembly slideably mounted on the base plate adjacent to the closed end of the slot;

a second gripping assembly;

locking means for fixing the second gripping assembly in a closed position relative to the base plate in which the second gripping assembly closes the open end of the slot; and actuating means for displacing the first gripping assembly relative to the base plate between a relaxed position and a gripping position; wherein the caisson is arranged within and removed from the slot when the first gripping assembly is in the relaxed position and the second gripping assembly is not in the closed position; and the caisson is fixed to the attachment point when the first gripping assembly is in the gripping position and the second gripping assembly is in the closed position.

9. A driving system as recited in claim 8, in which the locking means comprises first and second pivot pins that extend through the second gripping assembly and the base plate, where the first and second pivot pins are removable and, when one of the first and second pivot pins is removed, the second gripping assembly is pivotable about the other of the first and second pivot pins between an open position and the closed position.

10. A driving system as recited in claim 9, further comprising actuator means for displacing the first pin between an inserted position and a withdrawn position, where the second gripping assembly can rotate into the open position when the first pin is in the withdrawn position and is locked into the closed position when the first pin is in the inserted position.

11. A driving system as recited in claim 10, in which the actuator means comprises a piston assembly having one end attached to the base plate and a second end attached to the first pin, where extension and retraction of the piston assembly displaces the first pin along its axis between the inserted and withdrawn positions.

12. A driving system as recited in claim 8, further comprising a support plate arranged parallel to the base plate, where the first gripping assembly is arranged between the base plate and the support plate to limit movement of the first gripping assembly in a direction parallel to a lengthwise axis of the caisson.

13. A driving system as recited in claim 8, further comprising two pairs of support blocks rigidly fixed below the base plate, where the second gripping assembly is received between each pair of support blocks to limit movement of the second gripping assembly in a direction parallel to a lengthwise axis of the caisson.

14. A driving system as recited in claim 13, in which the locking means comprises first and second pivot pins that extend through the second gripping assembly, the base plate, and at least one of the support blocks, where the first and second pivot pins are removable and, when one of the first and second pivot pins is removed, the second gripping assembly is pivotable about the other of the first and second pivot pins between an open position and the closed position.

15. A method of driving into the earth at a desired location a caisson prepositioned above the desired location, the method comprising the steps of:

providing a driving device comprising (i) a base plate having a slot formed therein, (ii) a vibratory assembly rigidly mounted on the base plate, and (iii) a suppressor assembly rigidly connected to the vibratory assembly;

rigidly attaching the suppressor assembly to a sled movably mounted on a lead structure such that the suppressor assembly inhibits transmission of vibratory forces from the vibratory assembly to the lead structure;

mounting a clamping jaw to the base plate adjacent to a closed end of the slot therein;

displacing the lead such that the caisson enters the slot in the base plate in a first direction generally radial to a lengthwise axis of the caisson;

rigidly attaching a gate jaw in a closed position relative to the base plate such that the gate jaw prevents removal of the caisson from the slot in the base plate in a second direction opposite to the first direction;

gripping the caisson between the clamping jaw and the gate jaw by displacing the clamping jaw towards the caisson;

operating the vibratory assembly while gripping the caisson to apply a vibratory force to the caisson, thereby driving the caisson into the earth.

16. A method as recited in claim 15, in which the step of rigidly attaching the gate jaw to the base plate comprises the steps of:

providing a rigid structural member adapted to frictionally engage the caisson;

attaching the rigid structural member to the base plate adjacent to an open end of the slot therein.

17. A method as recited in claim 16, in which the step of attaching the rigid structural member to the base plate comprises the steps of:

providing first and second locking pins;

inserting the locking pins through holes in the base plate and the structural member to prevent relative movement therebetween.

18. A method as recited in claim 17, further comprising the steps of:

removing the first locking pin; and rotating the structural member about the second locking pin between the closed position and an open position; wherein the caisson is placed into and removed from the slot in the base plate when the structural member is in the open position.

19. A method as recited in claim 18, further comprising the steps of:

mounting a piston assembly to the base plate and the first locking pin; and operating the piston assembly to insert and withdraw the locking pin.

* * * * *